US011825965B2

(12) United States Patent
Olmstead

(10) Patent No.: US 11,825,965 B2
(45) Date of Patent: Nov. 28, 2023

(54) SYSTEM FOR MOUNTING OBJECTS TO A STRUCTURE

(71) Applicant: Mark Olmstead, Fort Worth, TX (US)

(72) Inventor: Mark Olmstead, Fort Worth, TX (US)

( * ) Notice: Subject to any disclaimer, the term of this patent is extended or adjusted under 35 U.S.C. 154(b) by 0 days.

(21) Appl. No.: 17/552,865

(22) Filed: Dec. 16, 2021

(65) Prior Publication Data

US 2023/0190016 A1 Jun. 22, 2023

(51) Int. Cl.
*A47G 1/16* (2006.01)

(52) U.S. Cl.
CPC ..... *A47G 1/1613* (2013.01); *A47G 1/16* (2013.01); *A47G 1/162* (2013.01); *A47G 1/1626* (2013.01)

(58) Field of Classification Search
CPC .... A47G 1/1613; A47G 1/162; A47G 1/1626; A47G 1/16; A47G 1/164; A47G 1/1606; A47G 1/686; A47G 1/166; A47B 81/061; A47B 81/062; A47B 81/065; A47B 81/064
USPC ..... 248/480, 489, 490, 481, 476, 479, 248/225.11, 298.1, 223.41; 52/710
See application file for complete search history.

(56) References Cited

U.S. PATENT DOCUMENTS 102,805 A * 5/1870 Gillishie ..... A47G 1/1613 248/498
445,305 A * 1/1891 Tidball ..... G09F 1/14 248/490
1,509,407 A * 9/1924 MacQuarrie ..... A47G 1/1686 248/307
2,632,971 A * 3/1953 Cashman ..... A47G 1/142 248/491
2,767,951 A * 10/1956 Cousino ..... F16B 37/046 411/116
3,250,584 A * 5/1966 Tassell ..... A47B 57/565 248/245
3,392,950 A * 7/1968 Pierce ..... A47G 1/24 359/872
3,781,093 A * 12/1973 Grabijas ..... F16M 11/14 359/881
3,796,405 A * 3/1974 Rystad ..... E06B 3/02 248/316.7
3,838,842 A * 10/1974 McCracken ..... A47G 1/1613 248/476
4,373,279 A * 2/1983 Abel ..... B44D 3/185 248/490
4,387,875 A * 6/1983 Ohori ..... F16M 11/2092 248/480
4,835,852 A * 6/1989 Asplund ..... E04F 11/1804 33/645
5,090,143 A * 2/1992 Schier ..... G09F 1/12 40/757
5,878,987 A * 3/1999 Hayde ..... A47G 1/1613 248/495

(Continued)

*Primary Examiner* — Nkeisha Smith
(74) *Attorney, Agent, or Firm* — James E. Walton

(57) ABSTRACT

A system for mounting an object on a structure includes a pivoting mounting bracket portion and a rail portion. The mounting bracket portion includes a front plate that is pivotally coupled to a back plate. The rail portion is shaped in the form a C-channel. The back plate is sized and shaped to snugly fit within the C-channel of the rail portion. The rail portion is configured to be attached to the structure, and the front plate is configured to be attached to the object.

13 Claims, 9 Drawing Sheets

(56) References Cited

U.S. PATENT DOCUMENTS

| | | | | |
|---|---|---|---|---|
| 6,131,866 | A * | 10/2000 | Kesinger | A47B 96/067 248/225.11 |
| 6,390,433 | B1 * | 5/2002 | Kasa-Djukic | A47B 97/04 248/458 |
| 6,550,739 | B1 * | 4/2003 | Brindisi | A47G 1/1613 248/496 |
| 6,557,813 | B1 * | 5/2003 | Duggan | A47G 1/1613 248/495 |
| 6,682,033 | B1 * | 1/2004 | Cohen | A47G 1/17 248/220.22 |
| 7,661,640 | B2 * | 2/2010 | Persson | F16M 13/02 248/225.11 |
| 7,686,275 | B2 * | 3/2010 | Scarcello | F16M 11/14 248/231.91 |
| 8,550,415 | B2 * | 10/2013 | Sculler | H05K 5/0017 248/495 |
| 8,596,599 | B1 * | 12/2013 | Carson | F16M 11/2085 248/920 |
| 10,349,760 | B2 * | 7/2019 | Peake | A47G 1/166 |
| 10,429,002 | B2 * | 10/2019 | Carnevali | F16M 13/02 |
| 2007/0040089 | A1 * | 2/2007 | Shiff | A47B 97/04 248/455 |
| 2011/0138666 | A1 * | 6/2011 | Borde | A47G 1/166 40/747 |
| 2013/0097906 | A1 * | 4/2013 | Schultz | A47G 1/166 40/747 |
| 2014/0145049 | A1 * | 5/2014 | Magnusson | A47F 5/0846 248/223.41 |
| 2016/0270564 | A1 * | 9/2016 | Peake | A47G 1/166 |

* cited by examiner

SYSTEM FOR MOUNTING OBJECTS TO A STRUCTURE

BACKGROUND

1. Field of the Invention

The present application relates to systems and methods for mounting objects to structures. In particular, the present application relates to systems and methods for mounting paintings and artwork to walls.

2. Description of Related Art

Displaying artwork on walls is as old as artwork itself. By mounting the artwork on walls and other structures, the artwork can be seen and enjoyed by many people at once. However, mounting artwork to walls and other structures for display is a job that can be very time consuming. Making sure the objects are level and straight can be a difficult undertaking, particularly if the piece of artwork is large or bulky.

To hang small pieces of artwork, a small bracket is attached to the back of the artwork or the artwork's frame. Then, a nail or pin is installed onto the wall and the artwork is hung by placing the bracket over the nail. Of course, there are many other ways to hang artwork, including the use of wire hangers, eye bolts, etc. However, it will be appreciated that extra work must be done to hang large pieces of artwork to ensure that the artwork remains in place on the wall. Once the artwork is hung, it must be periodically adjusted and straightened to make sure that the artwork remains straight and level. In commercial settings, the artwork is often secured to the wall with fasteners to prevent the artwork from being tampered with or stolen.

Although great strides have been made in the area of hanging artwork, many shortcomings remain.

BRIEF DESCRIPTION OF THE DRAWINGS

The novel features believed characteristic of the present application are set forth in the appended claims. However, the present application itself, as well as a preferred mode of use, and further objectives and advantages thereof, will best be understood by reference to the following detailed description when read in conjunction with the accompanying drawings, wherein:

DETAILED DESCRIPTION OF THE PREFERRED EMBODIMENT

Figure 1:
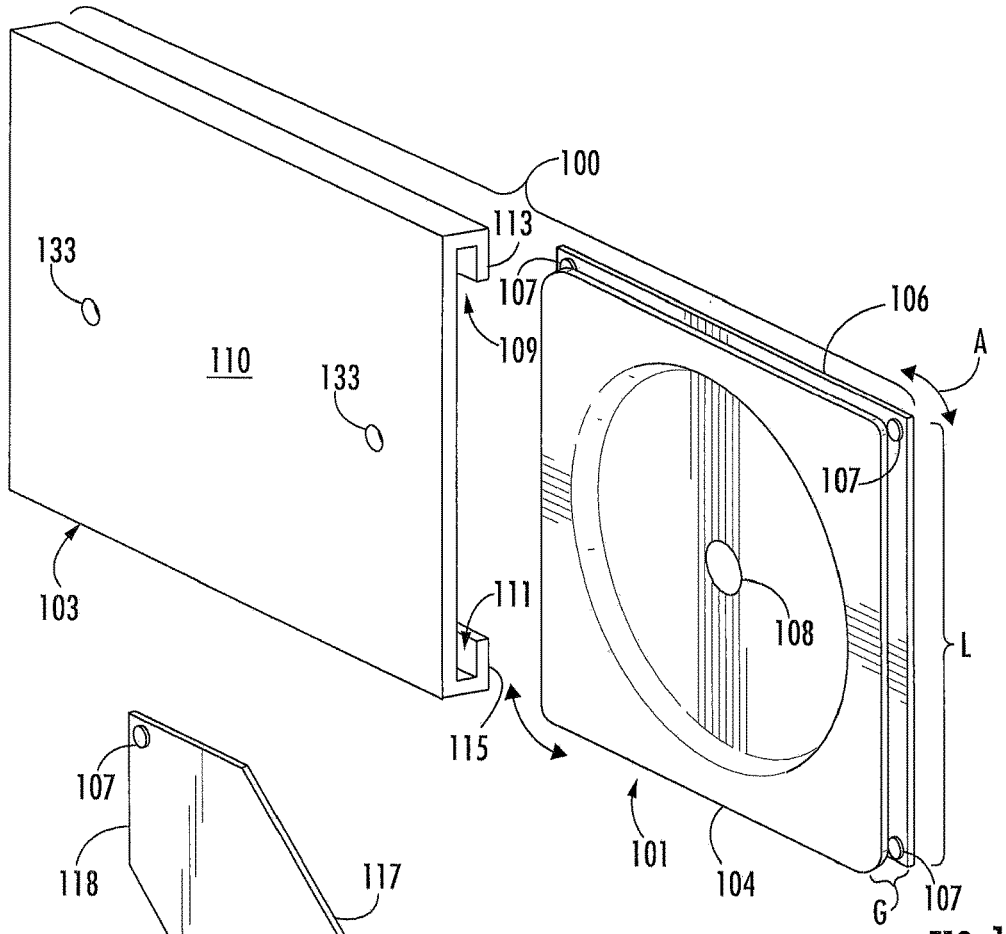
FIG. 1 is a perspective view of a system for mounting objects to structures having a mounting bracket portion and a rail portion according to a preferred embodiment of the present application.

Referring now to FIG. 1 in the drawings, a system 100 for mounting objects to structures according to a preferred embodiment of the present application is illustrated. System 100 includes a pivoting mounting bracket portion 101 and a corresponding rail portion 103. Mounting bracket portion 101 is sized and configured to slide into, snugly fit within, and slide within rail portion 103. When system 100 is attached to a piece of artwork, such as picture, a painting, a sign, etc., system 100 allows the user to move the artwork from side-to-side and to rotate the artwork relative to the structure on which system 100 is mounted.

Mounting bracket portion 101 includes a back plate 104 and a front plate 106. Front plate 106 is configured to swivel relative to back plate 104, via a swivel system 108. Swivel system 108 is preferably a ball bearing swivel system in which front plate 106 is coupled to back plate 104 via a ball bearing system. Swivel system 108 allows front plate 106 and back plate 104 to swivel a full 360 degrees relative to each other (see arrow A), while maintaining front plate 106 and back plate 104 in generally parallel planes. It will be appreciated that other types of swivel systems other than ball bearing systems may be utilized. Front plate 106 is configured to receive one or more fasteners 107 for fastening front plate 106 to a piece of artwork (see also FIG. 2D). Fasteners 107 may be pins, nails, screws, or any other suitable attachment device.

Rail portion 103 is preferably an elongated member having a C-channel configuration formed by a back wall 110, an upper guide channel 109, and a lower guide channel 111. Upper guide channel 109 includes an upper tab 113 and lower guide channel 111 includes a lower tab 115. The interior distance between upper guide channel 109 and a lower guide channel 111 is sized slightly larger than the exterior length L of back plate 104, so that back plate 104 will slide into the C-channel of rail portion 103 and be able to slide along rail portion 103, but will not wobble inside the C-channel. In other words, back plate 104 snugly fits with the C-channel, with just enough clearance to slide back plate 104 within rail portion 103 without binding. In addition, a selected gap G exists between front plate 106 and back plate 104, so that back plate 104 may slide within rail portion 103 without front plate 106 binding against either upper tab 113 or lower tab 115. Rail portion 103 is configured for attachment to a structure, such as a wall, a post, a door, or any other suitable structure. As such, rail portion 103 may include one or more mounting apertures 133.

Front plate 106 and back plate 104 are each preferably made of a metallic material, but can be made of plastic, composite, or any other similar material, or combination thereof. Similarly, rail portion 103 is preferably made of a metallic material, but can be made of plastic, composite, or any other similar material, or combination thereof.

Figure 2A:
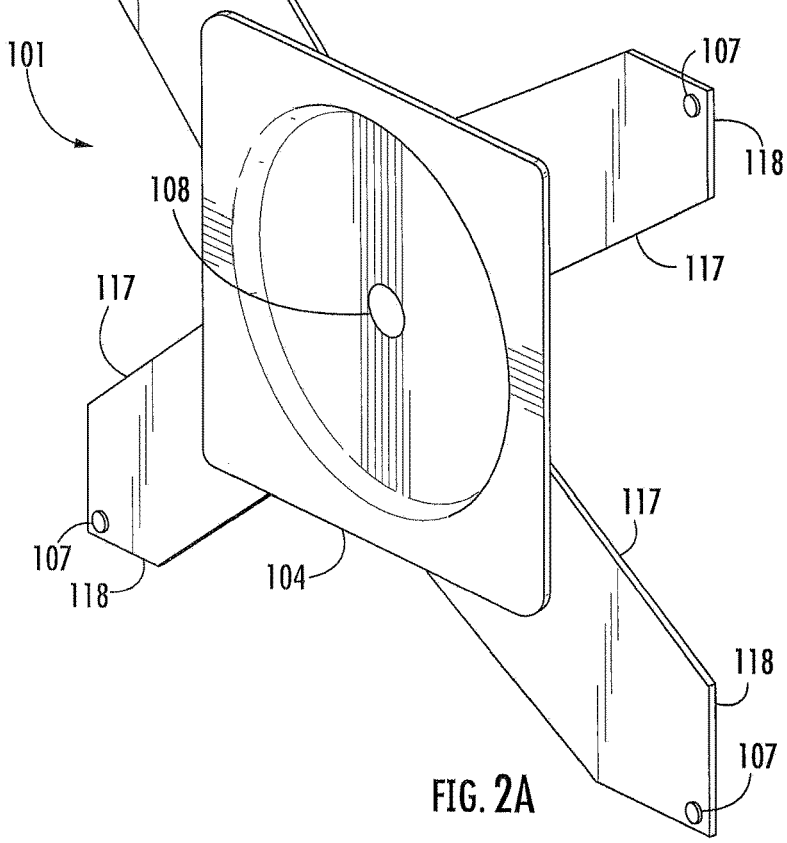
FIG. 2A is a perspective view of an alternative embodiment of the mounting bracket portion of the system for mounting objects to structures according to the present application.

Referring now also to FIG. 2A in the drawings, an alternative embodiment of mounting bracket portion 101 is illustrated. In this embodiment, front plate 106 is replaced with one or more front plate strips 117. Front plate strips 117 are preferably thin elongated strips that extend out radially from swivel system 108. Front plate strips 117 may terminate with pointed ends 118 to facilitate attachment to the corners of the piece of artwork. Front plate strips 117 are particularly useful when attaching mounting bracket portion 101 to a larger piece of artwork (see also FIGS. 8 and 9). Although front plate strips 117 are shown equally spaced apart and at 90 degree angles to each other, it will be appreciated that front plate strips may be spaced at any angle relative to each other, and may even be adjustable. For example, front plate strips may be spaced at 90 degrees to each other for square pieces of artwork, but may be spaced at other angles for rectangular pieces of artwork.

Figure 2B:
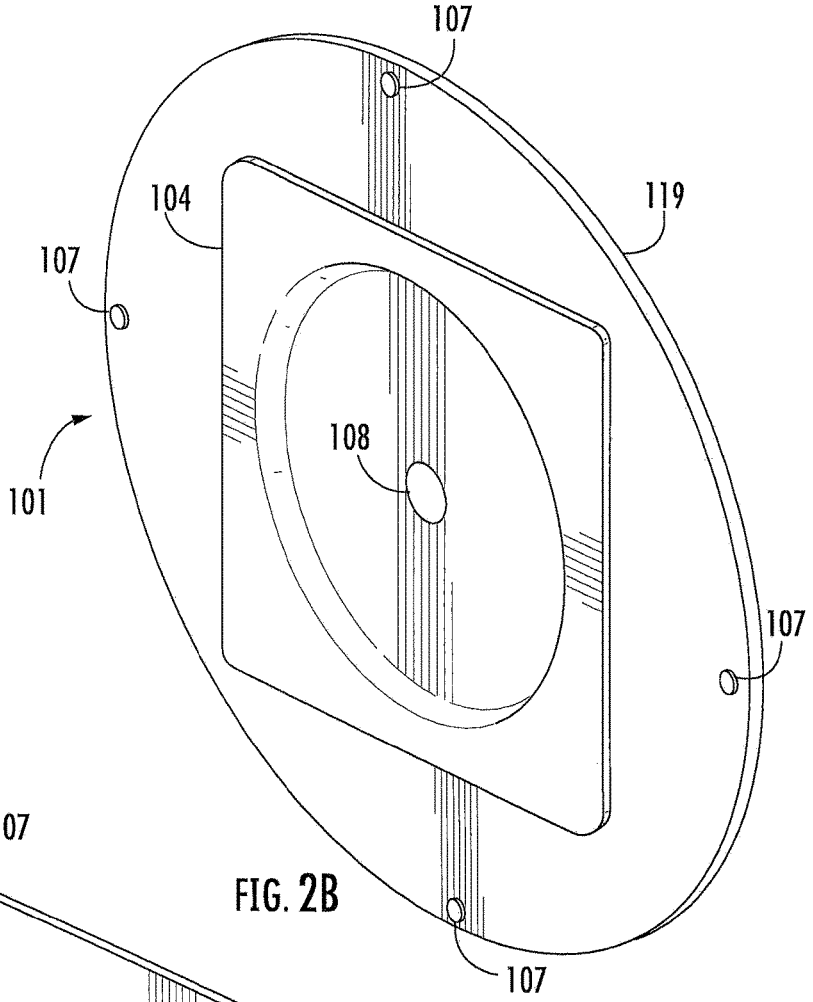
FIG. 2B is another alternative embodiment of the mounting bracket portion of the system for mounting objects to structures according to the present application.

Referring now also to FIG. 2B in the drawings, another alternative embodiment of mounting bracket portion 101 is illustrated. In this embodiment, front plate 106 is replaced with a front plate disk 119. Front plate disk 119 is preferably round in shape, but mat take on a wide variety of shapes, including other shapes with curved and or straight edges. It will be appreciated that fasteners 107 may be located at various locations around front plate disk 119.

Figure 2C:
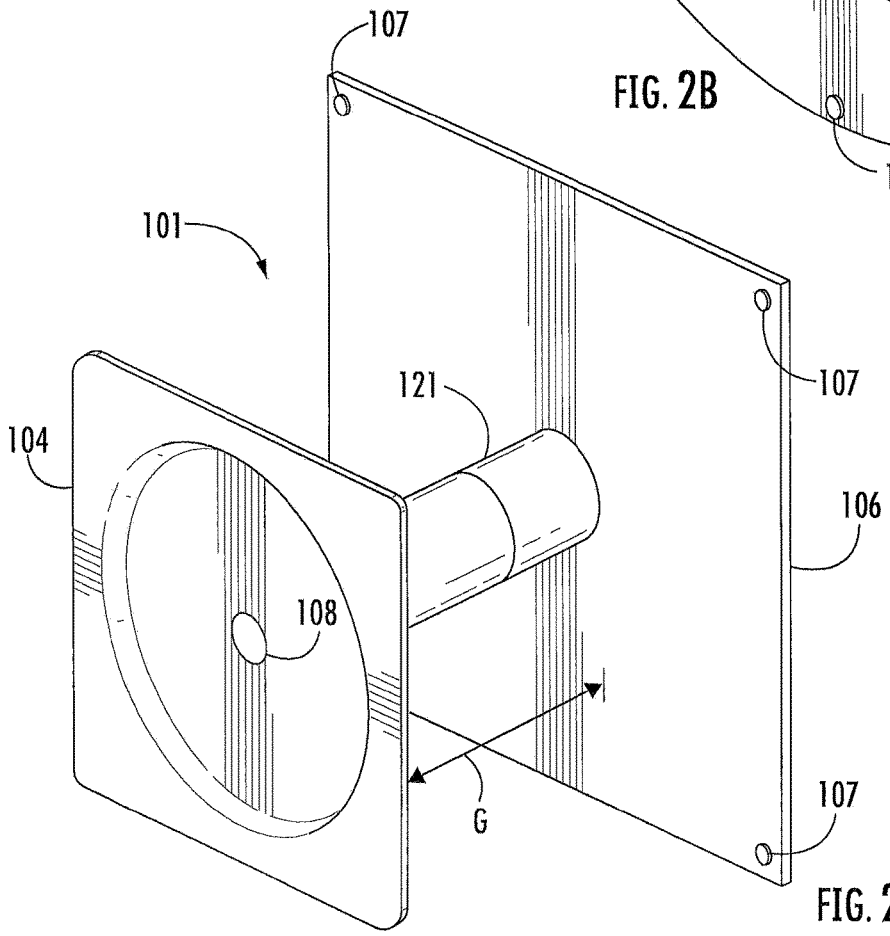
FIG. 2C is another alternative embodiment of the mounting bracket portion of the system for mounting objects to structures according to the present application.

Referring now also to FIG. 2C in the drawings, another alternative embodiment of mounting bracket portion 101 is illustrated. In this embodiment, front plate 106 and back plate 104 are coupled together via an adjustable coupling member 121. Coupling member 121 is preferably a telescoping shaft; however, it will be appreciated that coupling member may take on a variety of shapes and configurations. As with the previous embodiments, coupling member 121 is configured to allow front plate 106 and back plate 104 to swivel relative to each other via swivel system 108. In addition, coupling member 121 allows front plate 106 and back plate 104 to move toward and away from each other, while maintaining front plate 106 and back plate 104 in generally parallel planes. With this configuration, when front plate 106 is attached to a piece of artwork, the piece of artwork can be pulled away from the structure, rotated to a new orientation, and then pushed back into position, without having to slide back plate 104 from side-to-side inside rail portion 103.

Figure 2D:
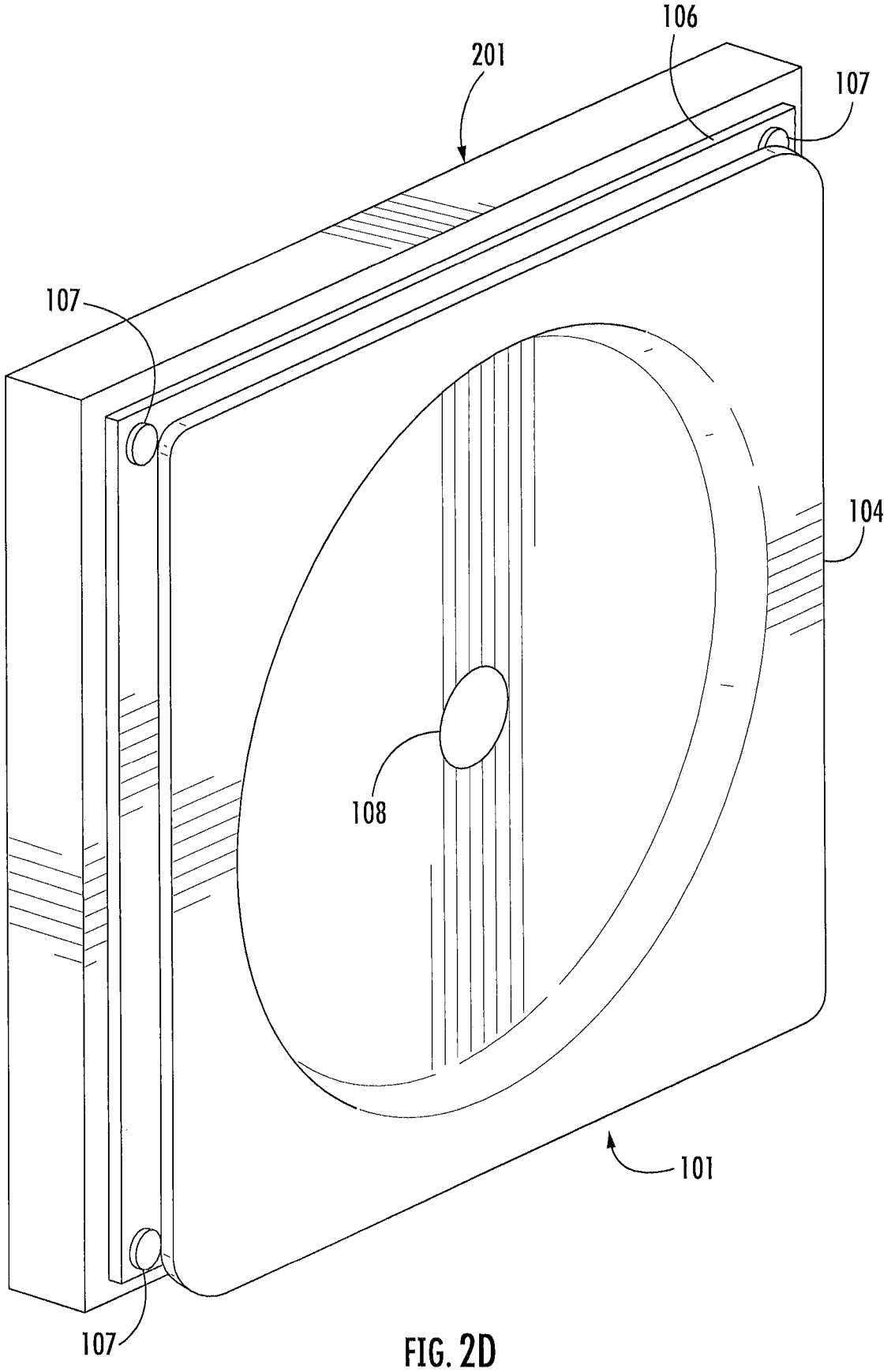
FIG. 2D is a perspective view of the mounting bracket portion of FIG. 1 shown attached to a piece of artwork.

Referring now also to FIG. 2D in the drawings, an object, in this case a canvas, or piece of artwork 201, is shown attached to front plate 106 via fasteners 107. It will be appreciated that artwork 201 may be much larger than depicted in FIG. 2D.

Figure 3:
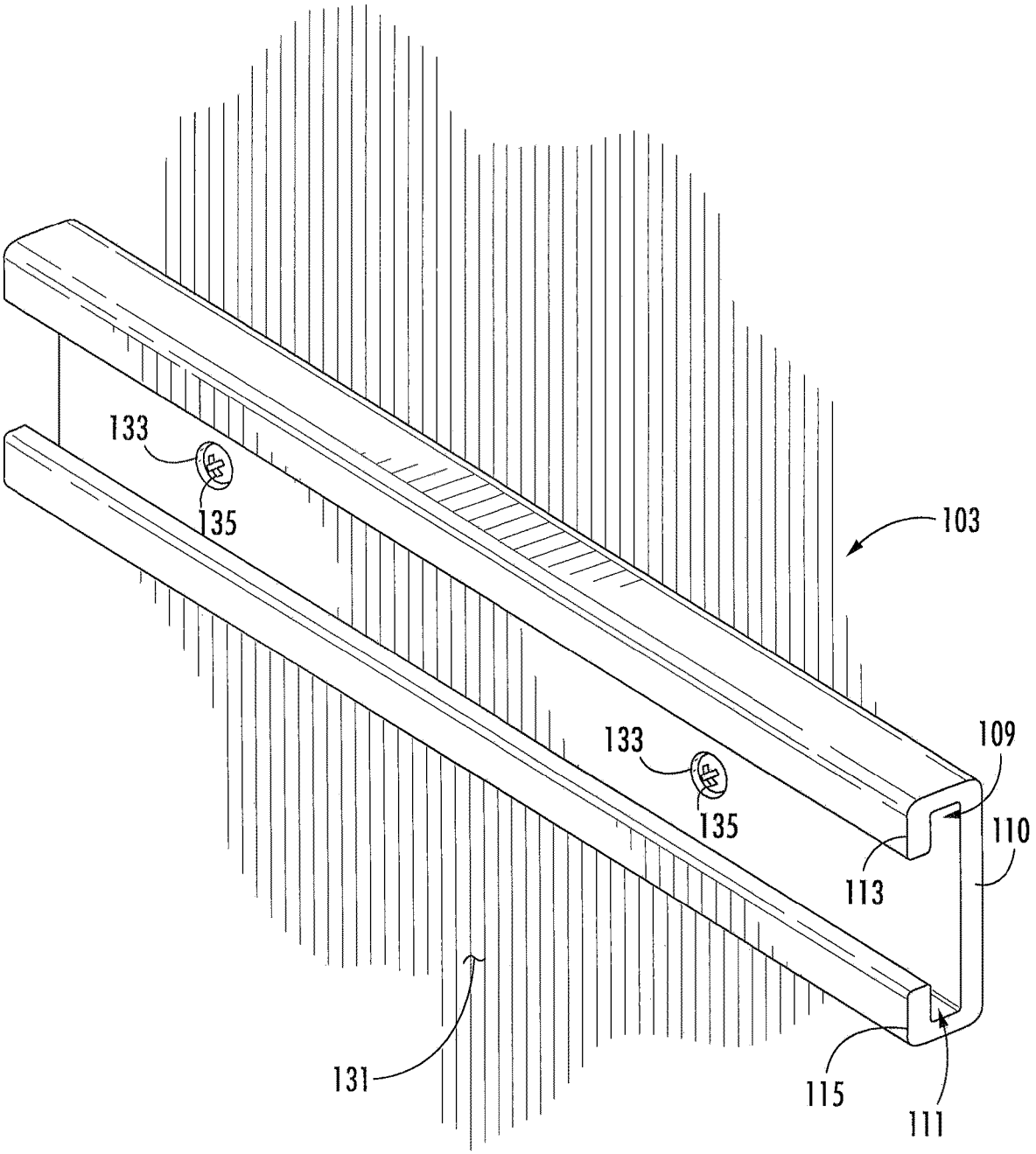
FIG. 3 is a perspective view of the rail portion of FIG. 1.

Referring now also to FIG. 3 in the drawings, rail portion 103 is illustrated attached to a structure, such as a wall 131. Rail portion 103 may include one or more mounting apertures 133 by which rail portion 103 may be attached to wall 131 by fasteners 135. Fasteners 135 may be pins, nails, screws, bolts, magnets, or any other suitable attachment mechanism.

Figure 4:
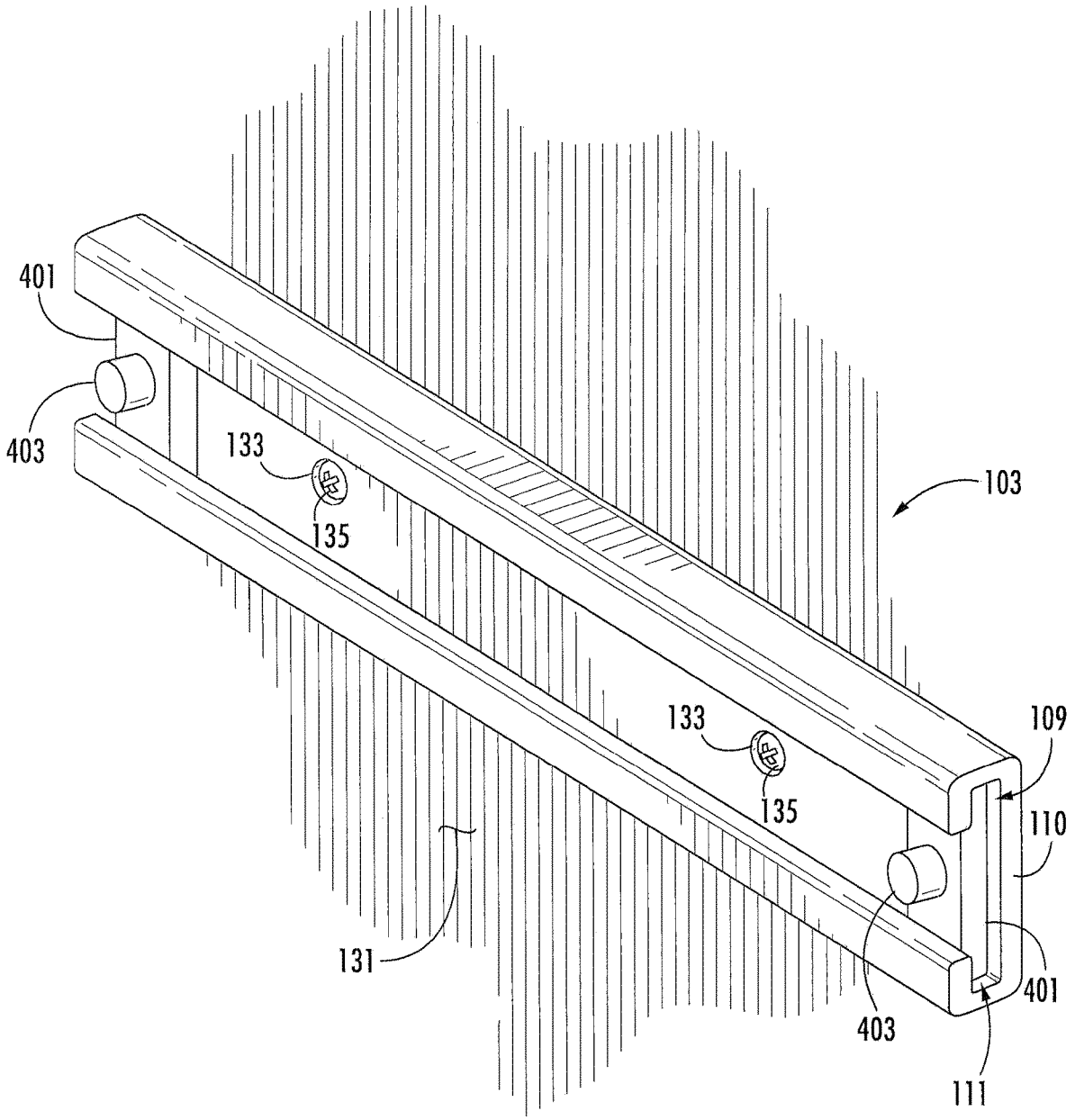
FIG. 4 is a perspective view of an alternative embodiment of the rail portion of the system for mounting objects to structures according to the present application.

Referring now also to FIG. 4 in the drawings, an alternative embodiment of rail portion 103 is illustrated. In this embodiment, rail portion 103 includes one or more stoppers 401. Stoppers 401 are sized and shaped to fit with the C-channel formed by back wall 110, upper guide channel 109, and lower guide channel 111. Stoppers 401 may be used to retain and support back plate 104 within rail portion 103. Stopper 401 may include a post 403 to aid in inserting and removing stopper 401 from rail portion 103. Stopper 401 may also be in the form of a detent integral with back wall 110.

Figure 5:
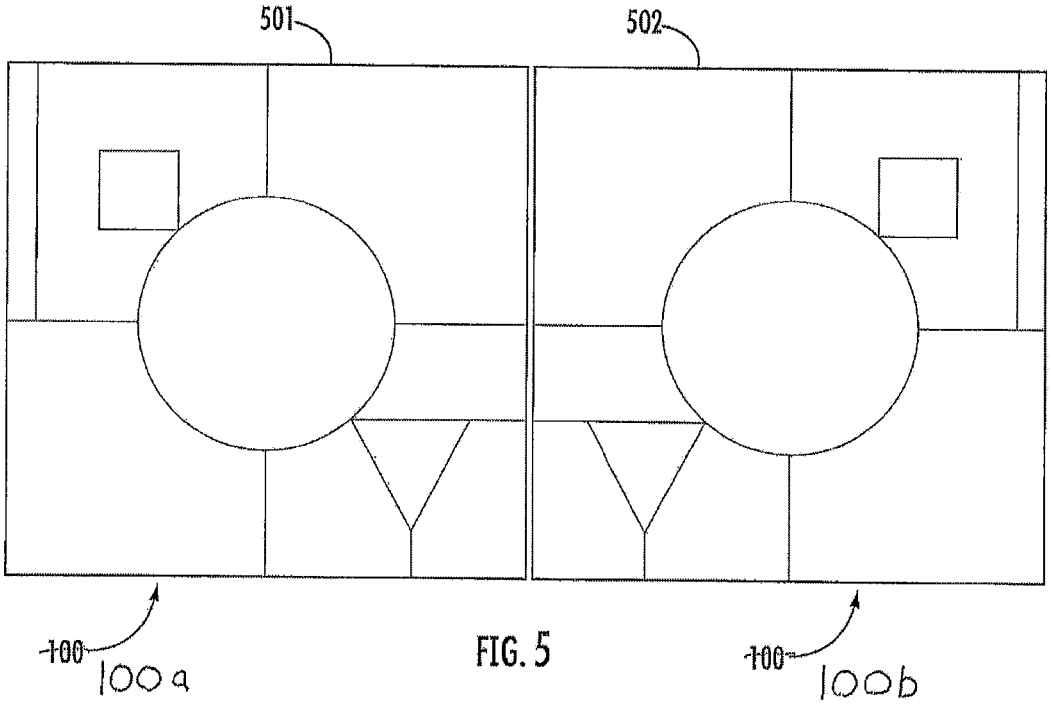
FIG. 5 is front view of a first arrangement of artwork attached to a wall using the system for mounting objects to structures according to the present application.
Figure 6:
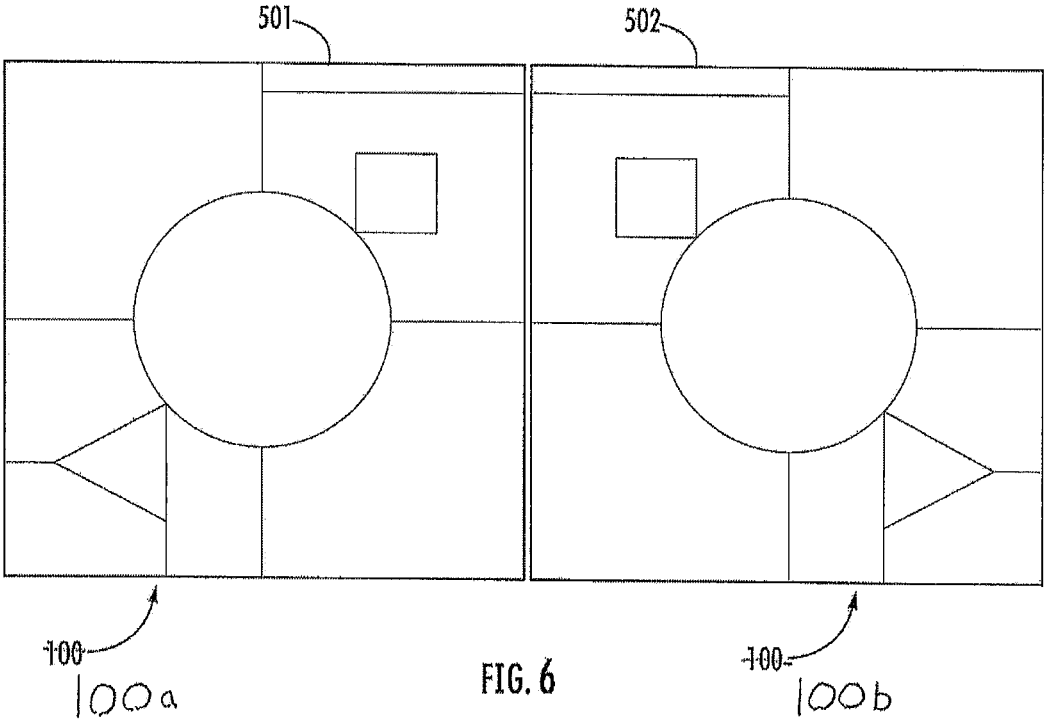
FIG. 6 is a front view of a second arrangement of the artwork of FIG. 5 using the system for mounting objects to structures according to the present application.

Referring now also to FIGS. 5 and 6 in the drawings, two of system 100, 100*a* and 100*b*, are being shown in use to mount and adjust pieces of artwork as is illustrated. In FIG. 5, two pieces of artwork 501 and 502 are shown hung on a wall next to each other. System 100*a* is attached to the rear of artwork 501 and system 100*b* is attached to the rear of artwork 502 (see also FIGS. 8 and 9). A gap has been shown between pieces of artwork 501 and 502 to distinguish the two pieces of artwork 501 and 502. It will be appreciated with the use of systems 100*a* and 100*b*, pieces of artwork 501 and 502 may be displayed with no gaps therebetween. In FIG. 6, with the aid of system 100*a*, piece of artwork 501 has been rotated 90 degrees in a clockwise direction, and, with the aid of system 100*b*, piece of artwork 502 has been rotated 90 degrees in a counter-clockwise direction. With systems 100*a* and 100*b*, this can be done without having to remeasure, relevel, or rehang either piece of artwork 501 or 502. Each piece of artwork 501 and 502 is merely slid to one side, rotated via front plate 106 and back plate 104, then slid back into place along rail portion 103. The use of the system and method of the present application makes this transformation quick and easy.

Figure 7:
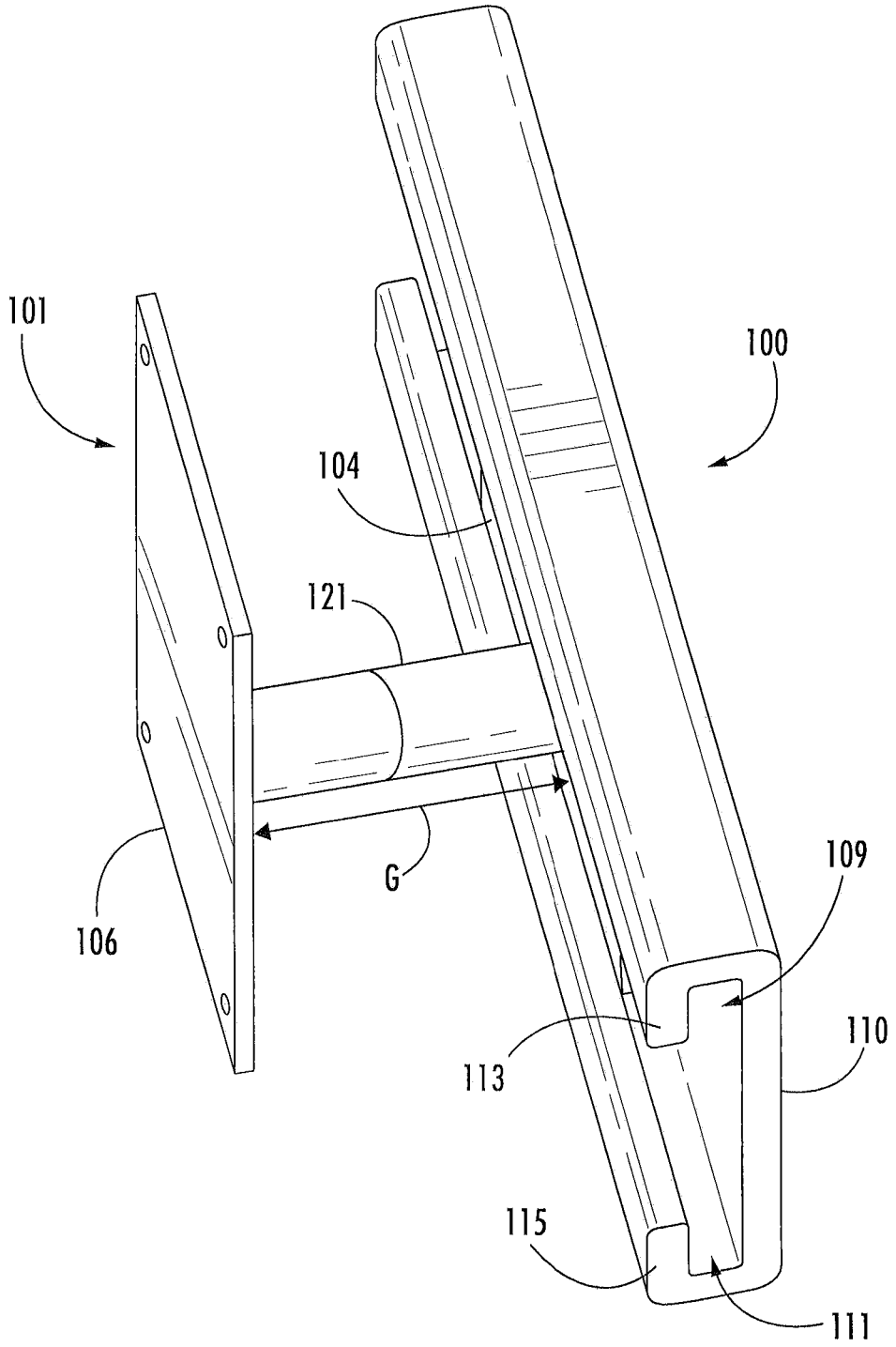
FIG. 7 is a perspective view of the system for mounting objects to structures using the mounting bracket portion of FIG. 1D and the rail portion of FIG. 3.

Referring now also to FIG. 7 in the drawings, an embodiment of system 100 utilizing rail portion 103 and mounting bracket portion 101 from FIG. 2C is illustrated. In this embodiment, front plate 106 may be telescopically adjusted relative to back plate 104. Thus, the orientation of a piece of artwork, such as artwork 501, may be altered by merely pulling artwork 501 away from the wall, rotating artwork 501, and then pushing artwork 501 back into place against the wall.

Figure 8:
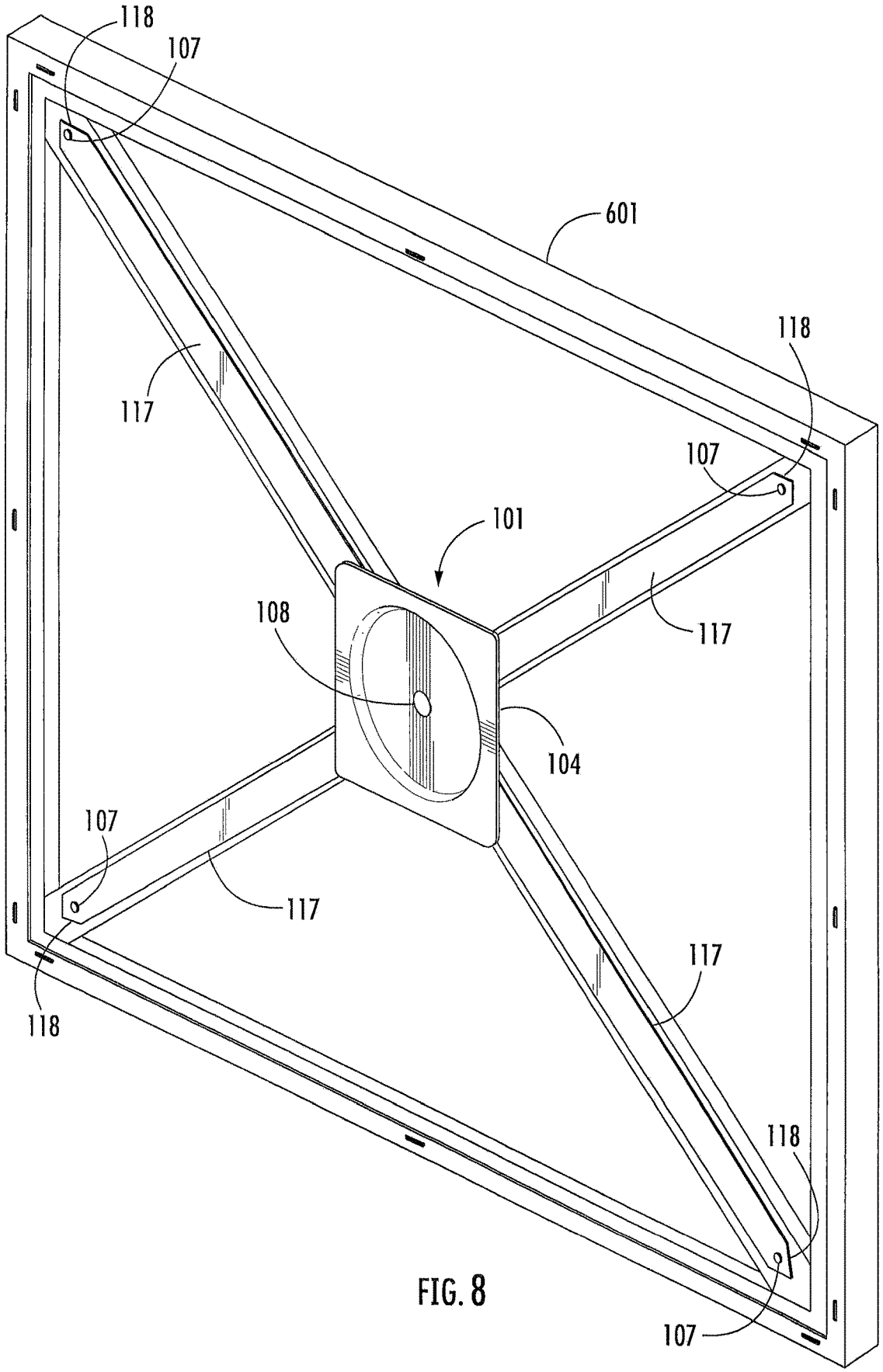
FIG. 8 is a perspective view of the mounting bracket portion of FIG. 1B shown with elongated attachment strips and being attached to a large piece of artwork.
Figure 9:
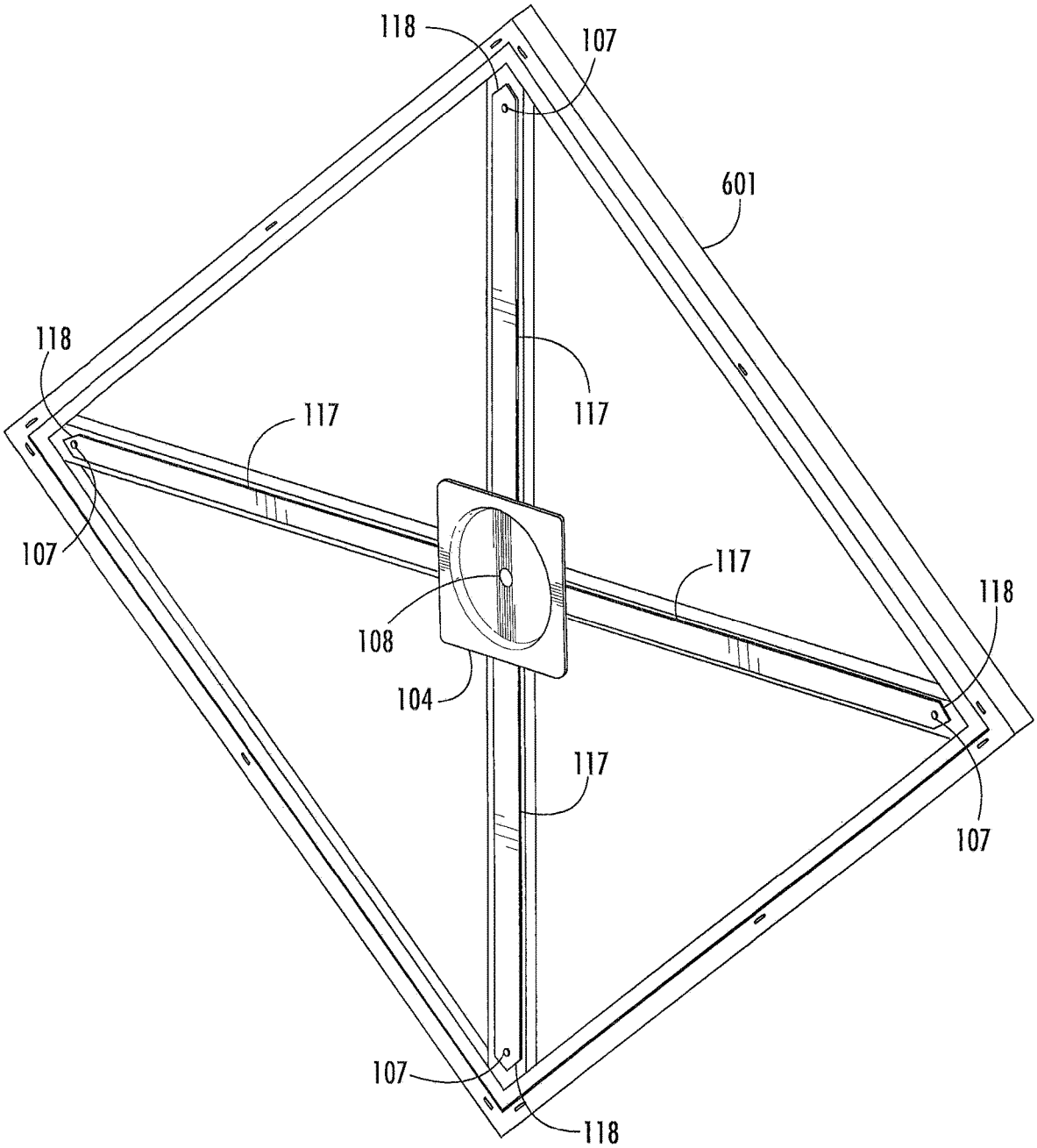
FIG. 9 is a perspective view of the mounting bracket portion of FIG. 8 shown being rotated 90 degrees relative to the piece of artwork.

Referring now also to FIGS. 8 and 9 in the drawings, the embodiment of mounting bracket portion 101 according to FIG. 2A mounted on a canvas 601 is illustrated. In this embodiment, front plate strips 117 are shown attached to canvas 601. It will be appreciated that although front plate strips 117 are only shown as being attached at the corners canvas 601, front plate strips 117 may be attached at multiple locations along the lengths of front plate strips 117 to canvas 601 for added stability. As is shown in FIGS. 8 and 9, back plate 104 is rotated 90 degrees relative to front strips 117.

It is apparent that a system and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A system for mounting an object on a structure, comprising:

a mounting bracket portion comprising:

a back plate; and a front plate pivotally coupled to the back plate, the front plate being configured for attachment to the object; and a rail portion configured for attachment to the structure, the rail portion being sized and shaped to slidingly receive the back plate from at least two sides;

wherein the back plate is sized such that once received by the rail portion, the back plate is secured in place;

wherein the front plate is rotatable at a fixed distance relative to the back plate while the back plate is contained by the rail portion; and wherein the front plate is pivotally coupled to the back plate via a ball bearing swivel system.

2. The system according to claim 1, wherein the rail portion comprises:

a C-channel sized and shaped to slidingly receive the back plate.

3. The system according to claim 1, wherein the front plate comprises:

one or more elongated front plate strips.

4. The system according to claim 1, wherein the front plate comprises:

a circular disk.

5. The system according to claim 1, wherein the front plate comprises:

a disk having curved and straight edges.

6. The system according to claim 1, further comprising:

one or more stoppers operably associated with the rail portion for retaining the back plate with the rail portion.

7. The system for mounting an object to a structure according to claim 1, wherein the structure comprises one of the following:

a wall;

a post; and a door.

8. The system for mounting an object to a structure according to claim 1, wherein the object comprises one of the following:

a picture;

a painting; and a sign.

9. A method of mounting an object on a structure, comprising:

providing a mounting bracket portion having a back plate and a front plate pivotally coupled to the back plate;

mounting the front plate to the object;

providing a rail portion;

attaching the rail portion to the structure; and sliding the back portion into one of at least two open sides of the rail portion;

wherein the back plate is sized so that once received by the rail portion, the back plate will be secured in place;

wherein the front plate is rotatable relative to the back plate while the back plate is contained by the rail portion; and wherein the front plate is pivotally coupled to the back plate with a ball bearing system.

10. The method according to claim 9, wherein the rail portion includes a C-channel sized and shaped to snugly receive the back plate.

11. A method of hanging multiple pieces of artwork on a structure and changing the orientation of the pieces of artwork relative to each other, the method comprising:

providing a first mounting system having a first pivoting mounting bracket portion and a first rail portion;

attaching the first rail portion to the structure;

attaching the first pivoting mounting bracket portion to a first piece of artwork;

sliding the first mounting bracket portion into the first rail portion, thereby hanging the first piece of artwork on the structure;

providing a second mounting system having a second pivoting mounting bracket portion and a second rail portion;

attaching the second rail portion to the structure;

attaching the second pivoting mounting bracket portion to a second piece of artwork; and sliding the second mounting bracket portion into the second rail portion, thereby hanging the second piece of artwork on the structure;

wherein the back plate is sized so that once received by the rail portion, the back plate will be secured in place.

12. The method according to claim 11, further comprising:

sliding the first piece of artwork relative along the first rail portion, so as to clear the second piece of artwork;

rotating the first piece of artwork about the first pivoting mounting bracket, so as to change the orientation of the first piece of artwork;

sliding the first piece of artwork back into place.

13. A system for mounting an object on a structure, comprising:

a mounting bracket portion comprising:

a back plate; and a front plate configured for attachment to the object;

a rail portion configured for attachment to the structure, the rail portion being sized and shaped to slidingly receive the back plate from at least two sides; and an adjustable coupling member for coupling the front plate to the back plate;

wherein the back plate is sized such that once received by the rail portion, the back plate is secured in place;

wherein the front plate is rotatable relative to the back plate while the back plate is contained by the rail portion; and wherein the adjustable coupling member is a telescoping shaft, whereby the front plate may translate relative to the back plate, such that the front plate and the back plate remain in generally parallel planes.

* * * * *